US007040665B2

(12) United States Patent
Ritchie et al.

(10) Patent No.: US 7,040,665 B2
(45) Date of Patent: May 9, 2006

(54) CARRIER SHEET WITH INTEGRATED DETACHABLE DIE-CUT CARD HAVING A MAGNET MATERIAL BACKING

(75) Inventors: William Dale Ritchie, Richmond (CA); Christopher Robert Cox, Orangeville (CA); Bill Garland, Mississauga (CA)

(73) Assignee: Relizon Canada Inc., Quebec (CA)

( * ) Notice: Subject to any disclaimer, the term of this patent is extended or adjusted under 35 U.S.C. 154(b) by 153 days.

(21) Appl. No.: 09/973,004

(22) Filed: Oct. 10, 2001

(65) Prior Publication Data

US 2003/0067159 A1 Apr. 10, 2003

(51) Int. Cl.
*B42D 15/00* (2006.01)

(52) U.S. Cl. ..... 283/82; 283/72; 283/81; 283/86; 283/61; 283/101; 283/105; 283/106; 40/600; 428/900; 428/42.1; 428/42.2; 428/42.3; 427/598; 273/239; 402/503; 281/DIG. 1

(58) Field of Classification Search ..... 283/81, 283/82, 72, 61, 76, 86, 101, 105; 428/900, 428/434, 42.1, 42.2, 42.3; 427/598; 273/239; 40/600; 402/503; 281/DIG. 1
See application file for complete search history.

(56) References Cited

U.S. PATENT DOCUMENTS 4,310,978 A * 1/1982 Stern ..... 40/600
4,379,573 A * 4/1983 Lomeli et al. ..... 428/42.3
4,544,590 A * 10/1985 Egan ..... 428/41.4
4,864,755 A * 9/1989 Owens ..... 40/594
4,960,651 A * 10/1990 Pettigrew et al. ..... 428/607
5,320,387 A * 6/1994 Carlson ..... 283/75
5,404,665 A * 4/1995 Choi ..... 40/630
5,439,255 A * 8/1995 McIntire et al. ..... 283/62
5,466,013 A * 11/1995 Garrison ..... 283/107
5,589,025 A * 12/1996 Garrison ..... 156/268
5,699,956 A * 12/1997 Brennan ..... 229/92.8
5,736,212 A * 4/1998 Fischer ..... 428/42.2
5,782,497 A * 7/1998 Casagrande ..... 283/110
5,833,274 A * 11/1998 Schmidt ..... 283/67
5,837,337 A * 11/1998 Schnitzer ..... 428/40.1
5,949,050 A * 9/1999 Fosbenner et al. ..... 235/449
5,994,990 A * 11/1999 Ogikubo ..... 335/285
6,019,280 A * 2/2000 Peterson ..... 229/305
6,022,051 A * 2/2000 Casagrande ..... 283/107
6,054,170 A * 4/2000 Chess et al. ..... 427/7
6,153,279 A * 11/2000 Charley ..... 428/40.1
6,235,378 B1 * 5/2001 Lowder ..... 428/215
6,318,757 B1 * 11/2001 Ritchie et al. ..... 283/75

(Continued)

*Primary Examiner*—Boyer D. Ashley
*Assistant Examiner*—Mark Henderson
(74) *Attorney, Agent, or Firm*—Jacobson Holman PLLC

(57) ABSTRACT

A carrier sheet comprising a printed paper sheet having an integrated detachable card with a magnetic backing and method of manufacturing same is described. The carrier sheet is comprised of a printed paper sheet having printed matter on at least a front face thereof. The printed matter contains card information printed in a card area. A polyfilm patch is adhered over the card area and over the card information printed thereon. A thin flexible patch of magnet material is adhesively secured on a rear face of the paper sheet and extends over the card area. A die-cut is made in the sheet and delineates the contour of the card area and extends through the polyfilm patch, the paper sheet and partly into the patch of magnet material to form a burstable region along said die-cut to hold the card in the carrier sheet. The die-cut can have any ornamental shape.

21 Claims, 2 Drawing Sheets

U.S. PATENT DOCUMENTS 6,403,184 B1 * 6/2002 Michlin ..... 428/40.1
6,533,325 B1 * 3/2003 Steidinger ..... 283/105
6,547,626 B1 * 4/2003 Burrows ..... 446/135
6,773,035 B1 * 8/2004 Cox et al. ..... 283/61
2002/0041093 A1 * 4/2002 Cox et al. ..... 283/61
2002/0081446 A1 * 6/2002 Boudouris et al. ..... 428/469
2002/0180206 A1 * 12/2002 Tronrud ..... 283/107
2003/0028439 A1 * 2/2003 Cox et al. ..... 705/26
2003/0038474 A1 * 2/2003 Maxted ..... 283/56
2003/0049403 A1 * 3/2003 Crum et al. ..... 428/42.3
2003/0049404 A1 * 3/2003 Mercer et al. ..... 428/42.3
2003/0077465 A1 * 4/2003 Boudouris et al. ..... 428/469
2003/0204980 A1 * 11/2003 Niec ..... 40/600
2004/0056476 A1 * 3/2004 Behnen ..... 283/61

* cited by examiner

CARRIER SHEET WITH INTEGRATED DETACHABLE DIE-CUT CARD HAVING A MAGNET MATERIAL BACKING

TECHNICAL FIELD

The present invention relates to a carrier sheet comprised of a printed paper sheet having printed matter thereon and a laminated die-cut card formed integral therewith with the card having a thin, flexible magnetic material backing and wherein the carrier sheet is capable of being personalized in a high-speed laser printer.

BACKGROUND ART

Refrigerator decals or cards having magnet backings laminated thereto for attachment to refrigerators or other metal surface are known. These decals are used mostly for advertising purposes. However, these decals are expensive to produce as the design thereon is usually made by a silk screen process or spot color printed. Such decals are also usually mailed out to intended users by glue-tipping them to a letter or they are simply inserted in an envelope together with a letter. The assembly of these mailers with these decals is usually done by hand, which increases the cost.

With the prior art processes, when it is necessary to produce a high volume of these decals, there is very little cost reduction. Also, it is very costly to change any information printed on these decals as it is required to change the plates in the print presses. Also, matching name and address on magnet decals, with the names on letters and envelopes is manual, costly and prone to error. Matching coloring graphic quality from magnet decal, letterhead and envelope is virtually impossible. With the prior art, the manufacturing process would comprise the production of an envelope, the production of a letterhead, the production of a magnet decal, letter lazering, assembly and insertion. This results in long cycle times, errors in the matching, high waste levels and often result in short shipments.

SUMMARY OF INVENTION

It is a feature of the present invention to provide a carrier sheet having an integrated die-cut card provided with a magnet backing patch and method of manufacturing same and which substantially overcomes the above disadvantages of the prior art.

It is another feature of the present invention to provide a carrier sheet, such as a mailer with an integrated card having a magnet backing which is thin, lightweight and wherein the printing in the mailer and on the card is high quality offset printing.

Another feature of the present invention is to provide a carrier sheet as above-described wherein the same quality of printing appears on the document and envelope and wherein the envelope can be formed integral with the mailer paper sheet.

Another feature of the present invention is to provide a carrier sheet as above-described which eliminates matching errors between the letter and information printed on the front face of the integral magnet card.

Another feature of the present invention is to provide a carrier sheet as above-described wherein the production thereof is cost effective, especially in high volumes and where text changes are required.

Another feature of the present invention is to provide a carrier sheet as above-described which can be used in high-speed laser printers to personalize the documents and wherein customer variable imaging on laser, ink jet or impact printing is achievable.

Another feature of the present invention is to provide a carrier sheet as above-described and wherein the card front face is laminated with a polyester film.

Another feature of the present invention is to provide a method of manufacture of a carrier sheet as above-described and wherein the die-cut extends only partly within the magnet material of the magnet patch to form a burstable region in the uncut region of the magnet material along the die-cut and thereby greatly prolonging the wear of the cutting die and preventing the die-cut card from disengaging with the carrier sheet in high speed printers.

According to the above features, from a broad aspect, the present invention provides a carrier sheet comprising a printed paper sheet having printed matter on at least a front face thereof. The printed matter contains card information printed in a card area. A polyfilm patch is adhered over the card area and over the card information printed thereon. A thin flexible patch of magnet material is adhesively secured on a rear face of the paper sheet and extends over the card area. A die-cut is made in the paper sheet and delineates the contour of the card area and extends through the polyfilm patch and paper sheet and into the patch of magnet material. Holding means are formed along the die-cut to hold the die-cut card in the paper sheet.

According to a further broad aspect of the present invention, the die-cut extends only partly into the magnet material to form a burstable region in the uncut region of the magnet material along the die-cut to constitute the holding means.

According to a still further broad aspect of the present invention there is provided a method of manufacturing a carrier sheet comprised of a printed paper sheet having an integrated detachable die-cut card having a magnet material backing. The method comprises printing on at least a front face of the paper sheet information matter at predetermined locations and card information in a card area. A polyfilm patch is secured over the card area and card information printed thereon. A thin flexible patch of magnet material is secured on a rear face of the paper sheet and extends over the card area. A delineated contour of the card area is die-cut from the front face. The die-cut extends through the polyfilm patch and paper sheet and into the patch of magnet material. The die-cut may also form holding tabs in the delineated contour.

According to a further broad aspect of the present invention the method also comprises die-cutting only partly into the patch of magnet material to form a burstable region in the uncut region of the magnet material along the die-cut.

According to a still further broad aspect the method comprises folding the carrier sheet into two or more panels to form a mailer with the personalized information containing an address on an outer face of one of the panels and with the die-cut card being located in another panel, and wherein the panels are secured to one another by adhesive strips, tabs or other fastening means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
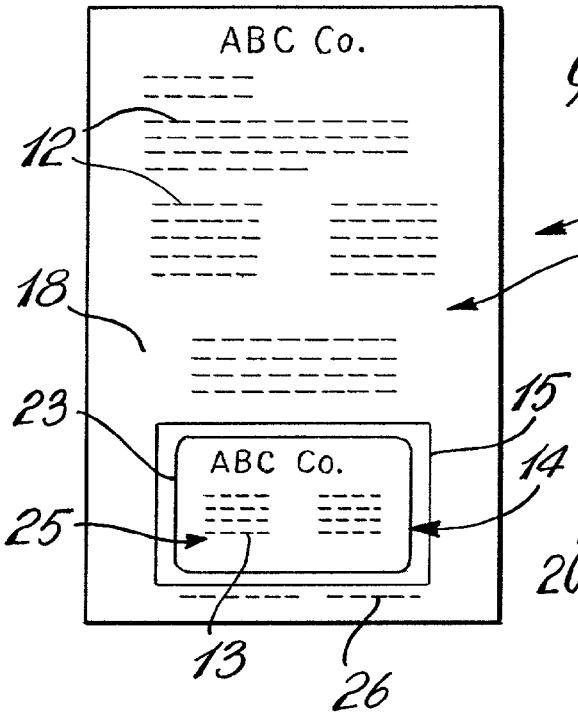
FIG. 1 is a plan view of a carrier sheet mailer constructed in accordance with the present invention.
Figure 2:
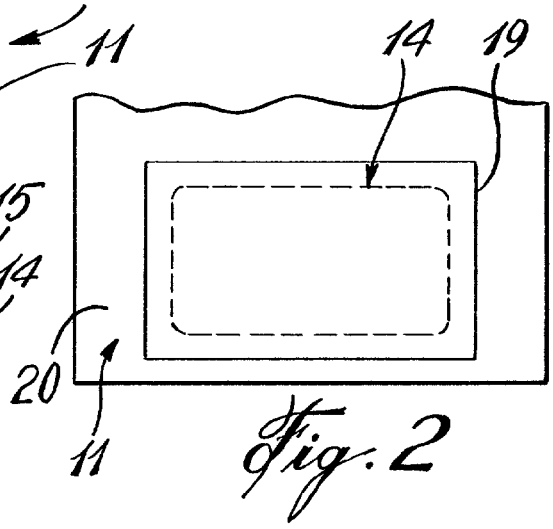
FIG. 2 is a fragmented plan view showing the rear face of the mailer where the magnet patch is adhesively secured.

Referring now to the drawings, and more particularly to FIGS. 1 and 2, there is shown generally at 10, a carrier sheet, herein a mailer constructed in accordance with the present invention. It is comprised of a printed paper sheet 11 which contains printed matter 12 describing a service or otherwise and associated with card information printed matter 13 printed in a card area 14.

Figure 4:
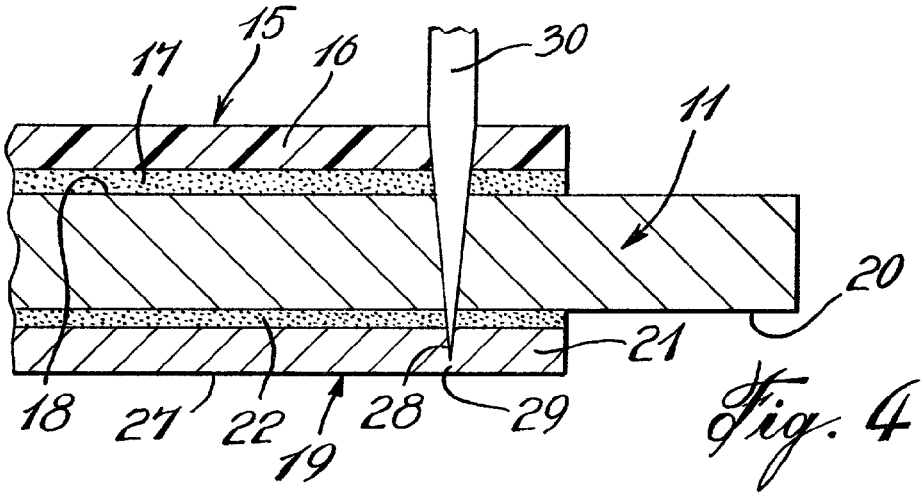
FIG. 4 is an enlarged fragmented section view illustrating the die-cut extending only partly within the magnet material to form a burstable region along the die-cut.

Referring now additionally to FIG. 4, it can be seen that a polyfilm patch 15 is adhesively secured over the card area and over the card information 13 printed in the card area. The polyfilm patch is comprised of a thin polyethylene sheet 16 and an adhesive 17 which bonds the polyethylene film to the front face 18 of the paper sheet 11 over the card area.

Referring additionally to FIG. 2, it can be seen that a thin flexible patch of magnet material 19 is adhesively secured on a rear face 20 of the paper sheet 11 and extends over the card area 14. The magnet material patch 19 comprises a thin layer or sheet 21 of magnetized iron oxide material provided with an adhesive backing 22 to secure same to the rear face 20 of the paper sheet 11.

Figure 5:
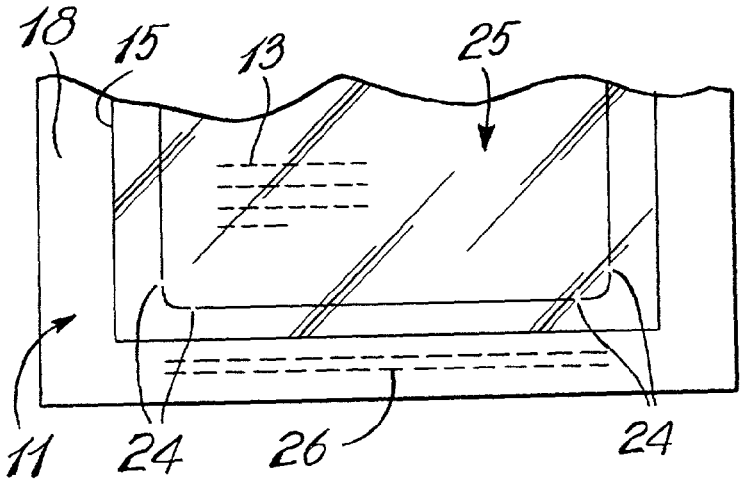
FIG. 5 is an enlarged fragmented front view of the carrier sheet showing the holding tabs in the die-cut.

With additional reference now to FIG. 5, it can be seen that a die-cut 23 delineates the contour of the card 25 formed integral with the paper sheet. The cutting die may have slits, as is well known in the art, to form holding tabs 24 along the die-cut, see FIG. 5, and these are usually disposed in the corners of the rectangular shaped card herein shown, although they can be located elsewhere. These tabs constitute one example of a holding means. Instructional information 26 may be printed below the polyfilm patch to instruct the user as to how to detach the card from the mailer. It will pop out by applying finger pressure.

Figure 3:
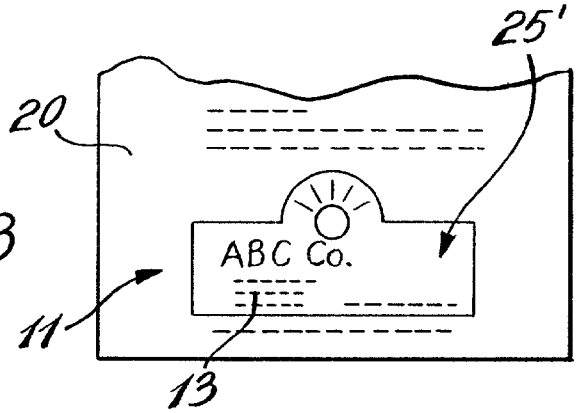
FIG. 3 is a fragmented view of a carrier sheet front face showing the further ornamental shape of the die-cut card.

FIG. 3 illustrates a die-cut card 25' having a different ornamental shape. In fact these cards or ornaments may have a multitude of shapes and uses.

With reference now more specifically to FIG. 4, there is shown a preferred embodiment of how the die-cut knife 30 penetrates through the mailer to delineate the card 25. As hereinshown the knife tip 28 only extends partly through the magnet film sheet 21 whereby to form a burstable region 29 in the uncut region between the tip 28 of the die-cut knife 30 and the outer surface 27 of the magnetic film sheet 21. This burstable region may be in the range of 6/1000 of an inch. The burstable region constitutes another form of holding means wherein it is not necessary to form holding tabs. The reason the die does not penetrate the magnet film is to prolong the life of the die-cut knife permitting such carrier sheets to be formed in high speed machines and in large quantities without having to frequently replace the die-cut knife which is a very expensive part of such machines. It is also pointed out that this carrier sheet can be personalized in a computerized high-speed printing machine.

Figure 6:
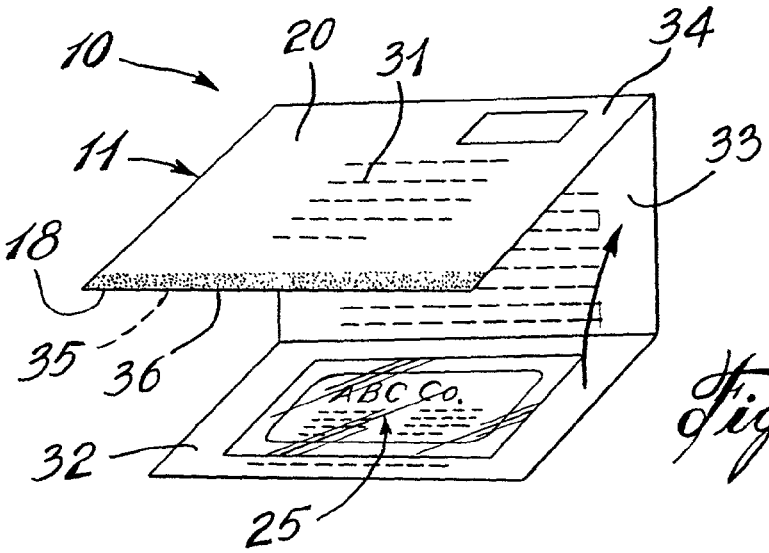
FIG. 6 is a perspective view showing a carrier sheet constructed in accordance with the present invention and comprised of three panels which are folded together to form an integral envelope for the mailer.
Figure 7:
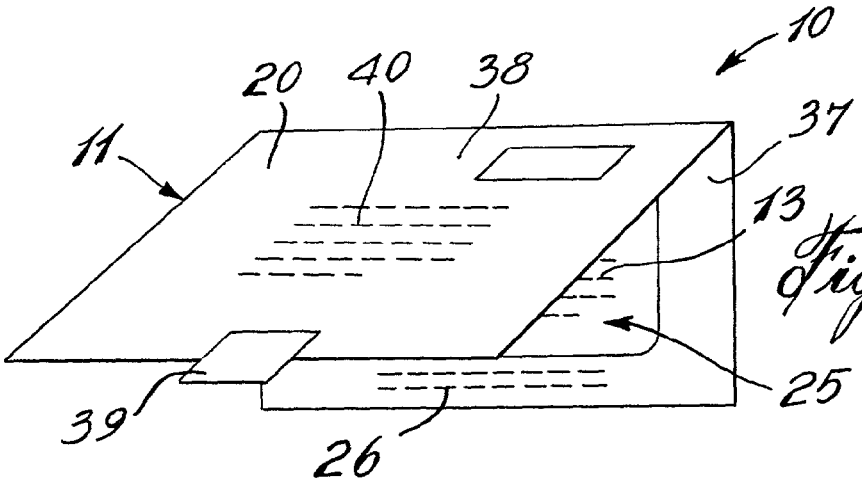
FIG. 7 is a perspective view showing the carrier sheet of the present invention formed of two panels which are secured together by an adhesive tab to also form an integral envelope for the mailer.

As shown in FIGS. 6 and 7, the mailer sheet 11 may be printed on the rear face 20 thereof to personalize the mailer to a recipient whose name is printed, such as 31 on the rear panel. The carrier sheet as shown in FIG. 6 is folded into three panels with the bottom panel 32, containing the card 25, being folded onto the intermediate panel 33 and then the top panel 34 is folded thereover. The folded panels may be secured together by an adhesive strip 35 which may have been applied on the front face 18 of the carrier sheet and along the upper edge 36 thereof.

FIG. 7 shows another form of envelope mailer and wherein the printed paper sheet 11 is folded into two sections to form a back panel 37 and a top panel 38. An adhesive tab 39 may be secured along an outer edge of either the front or rear panels to secure the panels together. There are many other ways to secure the panel together, and this is also well known in the art. The rear panel 37 would contain the detachable card 25. Again, the rear face 20 of the paper sheet 11 contains a personalized address 40 of an intended recipient. There are of course many other envelope configurations that can be achieved and many ways of forming an envelope integral with the mailer and it is within the ambit of the present invention to cover all these.

Briefly summarizing the method of manufacturing of the carrier sheet, it consists of printing at least the front face of the paper sheet with information matter at predetermined locations and also printing card information in the card area 14. The polyfilm patch and the thin flexible magnet patch may be applied by the same machine in a single run of the film sheet or may be done at separate stages or in separate machines. The die-cutting is then effected in the manner as above-described. You now have a mailer with an integrated card having a magnet backing and this mailer can be sent to intended recipients in envelopes. On the other hand, the mailer can be fed through a high-speed computer control laser printing machine (not shown, but obvious to a person skilled in the art) where the paper sheet can be personalized to a recipient, folded into two or more panels and also adhesively secured with a stamp printed thereon ready for mailing. As above-described, in order to greatly prolong the use of the cutting die, and also to provide good retention of the die-cut card for processing in a high-speed printer, it is preferable that the die-cut only extends partly into the patch of magnet material to form a burstable region in the uncut region of the magnet material along the die-cut. This prevents wear on the tip of the knife when passing through the material and striking a hard backing surface. By pushing the card out of the paper form, the magnet material will burst along the die-cut to create a clean, sharp cut along the outer edges of the card.

It is within the ambit of the present invention to cover any obvious modifications of the preferred embodiment described herein provided such modifications fall within the scope of the appended claims.

The invention claimed is:

1. A carrier sheet comprising:

a printed single paper sheet having a contour and having printed matter on at least a front face thereof, said printed matter containing card information printed in a card area having a contour smaller than the contour of the paper sheet, and said paper sheet having other information outside the card area, a polyfilm patch adhered over said card area and over said card information printed thereon, a thin flexible patch of magnet material adhesively secured on a rear face of said paper sheet and extending over said card area, said patch of magnet material having a bottom surface and a contour smaller than the contour of the paper sheet and larger than the contour of said card area, a die-cut in said paper sheet delineating the contour of said card area and extending depth-wise through said polyfilm patch and paper sheet and only partly into said patch of magnet material, and continuous, burstable holding means defined between the bottom of said die-cut and said bottom surface of said patch of magnet material for holding said die-cut card area in said paper sheet.

2. A carrier sheet as claimed in claim 1 wherein said die-cut has an ornamental shape.

3. A carrier sheet as claimed in claim 1 wherein said printed matter is a common message, said carrier sheet with said die-cut card area being personalized in a laser printing machine.

4. A carrier sheet as claimed in claim 1 wherein said die-cut card is a promotional magnet card.

5. A carrier sheet as claimed in claim 1 wherein said printed paper sheet is machine foldable in panels to constitute a glue fold envelope mailer containing an outer printed address panel, and an inner printed message form containing said die-cut card in a panel thereof.

6. A carrier sheet as claimed in claim 1 wherein said carrier sheet is a mailer of sufficient size to be foldable into at least two panels for mailing, and wherein said card area is positioned in one of said at least two panels.

7. A carrier sheet as claimed in claim 1 wherein the other information outside the card area is associated with the card information.

8. The carrier sheet as claimed in claim 1, wherein said continuous, burstable holding means holds said die-cut card area in said paper sheet without holding tabs.

9. A carrier sheet comprising:

a single paper sheet having a contour and front and rear faces, said front face including a card area on said front face, said card area having a contour smaller than the contour of the paper sheet and being printable with card information, and said front face also including a printable area outside said card area, a polyfilm patch adhered over said card area on said front face of said paper sheet, a thin flexible patch of magnet material adhesively secured on said rear face of said paper sheet and extending over said card area, said patch of magnet material having a contour smaller than the contour of the paper sheet and larger than the contour of said card area, a die-cut in said paper sheet delineating the contour of said card area and extending depth-wise through said polyfilm patch and paper sheet and only partly into said patch of magnet material, and continuous, burstable holding means defined between the bottom of said die-cut and said bottom surface of said patch of magnet material for holding said die-cut card area in said paper sheet.

10. A carrier sheet as claimed in claim 9 wherein said die-cut has an ornamental shape.

11. A carrier sheet as claimed in claim 9 wherein said front face of said carrier sheet is printable using a laser printer.

12. A carrier sheet as claimed in claim 9 wherein said die-cut card is a promotional magnet card.

13. A carrier sheet as claimed in claim 9 wherein said paper sheet is machine foldable in panels to constitute a glue fold envelope mailer containing an outer printable address panel, and an inner message form containing said die-cut card in a panel thereof.

14. A carrier sheet as claimed in claim 9 wherein said paper sheet is a mailer of sufficient size to be foldable into at least two panels for mailing, and wherein said card area is positioned in one of said at least two panels.

15. The carrier sheet as claimed in claim 9, wherein said continuous, burstable holding means holds said die-cut card area in said paper sheet without holding tabs.

16. A carrier sheet comprising:

a single sheet of letter-size paper having front and rear faces and being foldable into at least two panels for mailing, said front face including a card area, said card area having a contour smaller than the size of the paper sheet, being positioned in one of said at least two panels, and being printable with card information, and said front face also including a printable area outside said card area, a polyfilm patch adhered over said card area on said front face of said paper sheet, a thin flexible patch of magnet material adhesively secured on said rear face of said paper sheet and extending over said card area, said patch of magnet material having a contour smaller than the contour of the paper sheet and larger than the contour of said card area, a die-cut in said paper sheet delineating the contour of said card area and extending depth-wise through said polyfilm patch and paper sheet and only partly into said patch of magnet material, and continuous, burstable holding means defined between the bottom of said die-cut and said bottom surface of said patch of magnet material for holding said die-cut card area in said paper sheet.

17. A carrier sheet as claimed in claim 16 wherein said die-cut has an ornamental shape.

18. A carrier sheet as claimed in claim 16 wherein said front face of said carrier sheet is printable using a laser printer.

19. A carrier sheet as claimed in claim 16 wherein said die-cut card is a promotional magnet card.

20. A carrier sheet as claimed in claim 16 wherein on said rear face of said paper sheet, one of said panels contains an outer printable address panel, and wherein said inner face contains an inner message form containing said die-cut card.

21. The carrier sheet as claimed in claim 16, wherein said continuous, burstable holding means holds said die-cut card area in said paper sheet without holding tabs.

* * * * *